United States Patent [19]

Ferguson et al.

[11] Patent Number: 4,653,162

[45] Date of Patent: Mar. 31, 1987

[54] ASSEMBLY AND METHOD FOR COINING A PRECISION CORNER BREAK ON AN OIL METERING FLAT

[75] Inventors: Donald E. Ferguson, Mentor; Dennis L. Germovsek, Madison, both of Ohio

[73] Assignee: Buckeye International, Inc., Columbus, Ohio

[21] Appl. No.: 770,716

[22] Filed: Aug. 29, 1985

[51] Int. Cl.[4] ..... B21D 53/00; B21D 17/02

[52] U.S. Cl. ..... 29/157.1 R; 72/402; 72/311; 269/289 MR; 269/156; 269/233; 269/32

[58] Field of Search ..... 72/402, 393, 420, 452, 72/293, 311, 125; 269/289 MR, 156, 233, 32, 25; 29/157.1 R

[56] References Cited

U.S. PATENT DOCUMENTS

| | | | |
|---|---|---|---|
| 3,093,182 | 6/1963 | Vanderhoof | 72/402 |
| 3,094,702 | 6/1963 | Ustin et al. | 72/402 |
| 3,145,022 | 8/1964 | Moll | 269/25 |
| 3,281,926 | 11/1966 | Frastaci et al. | 72/410 |
| 3,800,386 | 4/1974 | Bishop | 29/157.1 R |
| 4,103,407 | 8/1978 | Elizalde et al. | 29/157.1 R |
| 4,391,120 | 7/1983 | Trevarrow | 72/402 |
| 4,472,959 | 9/1984 | Fencl | 72/402 |
| 4,550,588 | 11/1985 | Abe et al. | 72/472 |

*Primary Examiner*—Daniel C. Crane

*Attorney, Agent, or Firm*—Fay, Sharpe, Fagan, Minnich & McKee

[57] ABSTRACT

A method for coining a precision corner break on an oil metering flat for a rotor of a power steering rotary valve is provided. The method comprises the first step of placing a workpiece to be coined in a first floating position set by a clamping and orientating device where the workpiece is generally aligned but adjustable for further coining orientation if necessary. The next step comprises engaging the workpiece with a plurality of circumferentially spaced coining dies. The workpiece floats from the first floating position to a second coining position upon engagement by the dies. The last step comprises coining the workpiece to a precision depth selectively adjustable by adjustment of a motion conversion means. The press assembly includes fixed and movable platens, the movable platen being powered by a power cylinder assembly to direct the movable platen in a longitudinal direction in the press. The motion conversion means comprises matched angle camming surfaces of the die assembly and a drive block fastened to the fixed platen. As the camming surfaces engage, the longitudinal movement of the movable platen is converted to a radial movement of the dies into the workpiece adjustable by adjustment of the depth position of the die assembly drive block.

13 Claims, 11 Drawing Figures

FIG. 1
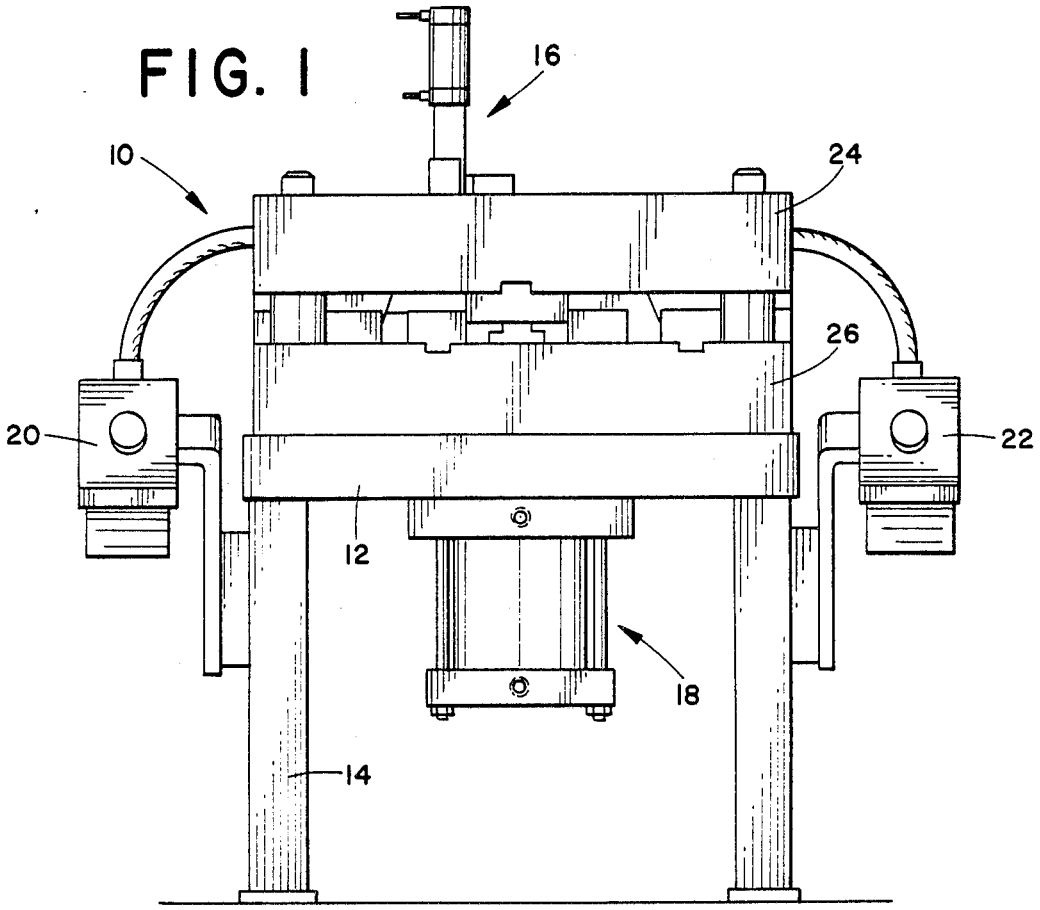
FIG. 2
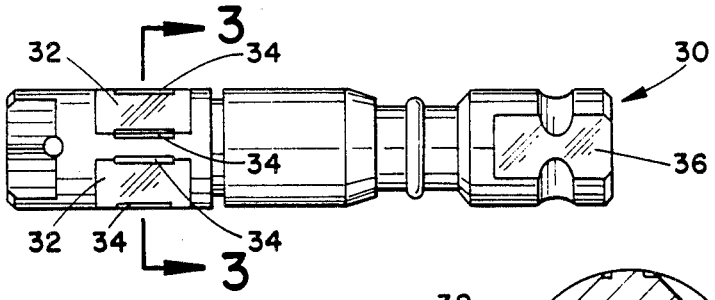
FIG. 4
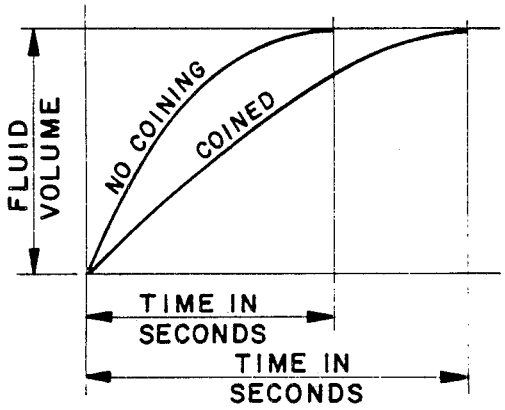
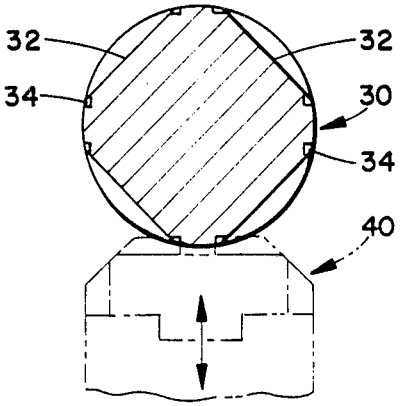
FIG. 3

FIG. 5
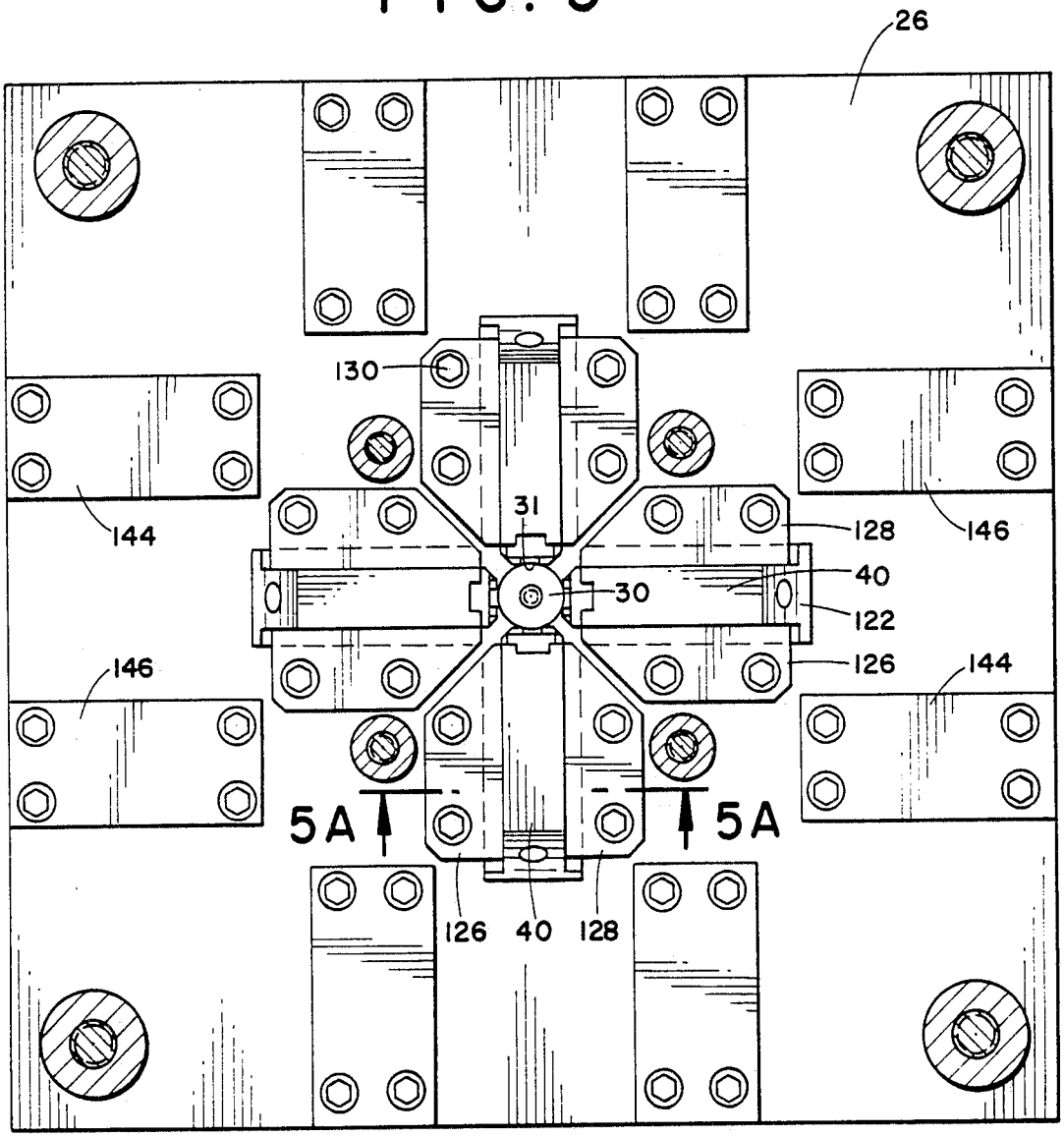
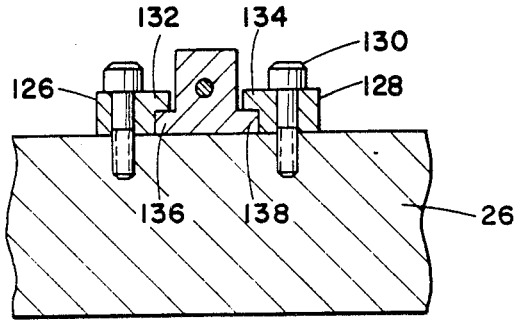
FIG. 5A

ASSEMBLY AND METHOD FOR COINING A PRECISION CORNER BREAK ON AN OIL METERING FLAT

BACKGROUND OF THE INVENTION

This invention pertains to the art of die presses and more particular to a coining press.

The invention is particularly applicable to an assembly for selectively coining a corner break or chamfer on an oil metering flat of a rotary valve rotor useful in a power steering assembly. However, it will be appreciated to those skilled in the art that the invention could be readily adapted for use in other environments as, for example, where similar precision coining assemblies and methods are employed for the manufacture of various other types of items.

Power steering rotary valve constructions are well known in the art as well as the advantages of providing precision corner breaks on rotor oil metering flats. (See U.S. Pat. No. 4,103,407 to Elizalde, et al.) The advantage of such a corner break is to provide a smoother operating power steering assembly. For example, with reference to FIG. 4, an illustrative graph is shown demonstrating that a rotor valve including a coined corner break at the oil metering flat requires a greater time for the power steering cylinder to reach its full volume. Operation of a rotor valve to reach full fluid volume without a coined metering flat requires substantially less time than one with a coined metering flat. By extending the time to get full action of the power steering mechanisms, the overall power steering assembly is smoothed and problems of oversteering, excessive responsiveness, and sensitivity are avoided.

Various forms and types of assemblies and methods for coining a metering flat corner break have heretofore been suggested and employed in the industry, all with varying degrees of success. It has been found that the defects present in most prior assemblies and methods are such that they are of limited economic and practical value. The degree of precision and uniformity of the corner break has largely dictated the success and value of the manufacturing method.

Typically, these prior corner break forming assemblies have variously comprised grinding, milling, radial punching or press rolling of oil metering flat corners.

All of these methods have suffered from the fundamental problem of an inability to provide a substantially uniform and precise oil metering flat corner break. This problem is largely the result of the distinct forming of corner breaks at different times, with different forming pressures, by a variety of power sources, involving varying angular movement between the forming tool and the workpiece in a complicated milling, rolling or punching machine. Such complexities have made it virtually impossible to repeat identical forming conditions and, thereby, repeat the production of an identical corner break about the rotor. The problems of fixturing misalignment, power fluctuation, inconsistency in high pressure power tools running at a relatively high speed of operation, workpiece contamination and rapid wear of grinding wheels or milling tools have all contributed to the problems of the prior known methods and assemblies. In addition, where high tolerances have been demanded and have been sought to be maintained in the manufacture of such pieces, the manufacturing methods have been so slow as to produce a relatively expensive piece at an undesirable production rate.

The present invention contemplates a new and improved method and assembly which overcomes all of the above referred to problems and others to provide a new method of manufacture of a precision corner break on an oil metering flat for rotary valve, and an assembly for implementing the method which is simple in design, economical in manufacture of the work items, readily adaptable to a plurality of uses with workpieces having a variety of dimensional characteristics, easy to set up, easy to operate and readjust and which provides improved precision and substantially uniform corner breaks on an oil metering flat.

BRIEF SUMMARY OF THE INVENTION

In accordance with the present invention, there is provided a method of coining a precision corner break on an oil metering flat for a rotary valve useful in a power steering assembly. The method comprises the first step of placing a workpiece to be coined in a receiving and retaining cavity in a coining press in a first floating position defined by a clamping and orientating device, which position is disposed for adjustable coining orientation during the actual coining operation. The next step comprises engaging the workpiece with a plurality of circumferentially spaced coining dies. The workpiece floats from the first position to a second coining position defined by equal force of engagement by the coining dies. The last step comprises coining the workpiece in a predetermined manner whereby the corner break is precisely coined at a certain position to a preselected depth.

In accordance with another aspect of the present invention, the clamping and orientating device includes a selectively operable piston cylinder assembly operatively engaged to a plurality of locating rollers and a workpiece clamping bar whereby the workpiece is orientated in the first floating position upon clamping engagement between the rollers and the clamping bar. The workpiece includes a locating flat disposed for generally mating engagement to an opposite flat of the clamping bar. A double slider coupling is included in the clamping and orientating device to allow for the floating support of the workpiece in a radial direction only until the workpiece is set in a coining position defined by equal circumferential engagement and pressure by the coining dies.

In accordance with a further aspect of the present invention, the coining dies are in operative engagement with one main power source, preferably comprising a piston and cylinder assembly. A motion conversion means for translating motion of the piston and cylinder assembly to the coining die is effective in consistently asserting the same amount of pressure on the workpiece to coin the workpiece to the same depth from each coining die. The coining dies are preferably received on a longitudinally movable platen powered by the piston and cylinder assembly. The motion conversion means comprises a first inclined face at a terminal end portion of a die holder slide to which the die head is fastened, and a second inclined face at a terminal end portion of a driving block disposed for camming engagement to the die holder slide inclined face. Radial movement of the die holder slide to the workpiece is effected by a longitudinal movement of the movable platen towards the driving block which is fixed to a fixed platen, thereby causing camming engagement between the inclined face of the driving block and the inclined face of the die holder slide. The driving block can be shimmed to adjust relative position to the fixed platen and, accordingly, the die holder slide to provide a precise coining depth.

In accordance with the present invention, an assembly is provided for selectively coining a corner break on an oil metering flat in accordance with the aforementioned method. The assembly includes a support means for supporting components of a coining press having a longitudinal axis. A plurality of circumferentially spaced dies are disposed for radial movement about the longitudinal axis. Power means are provided for selectively moving the dies. A motion conversion means is provided in operative communication between the power means and the dies for converting movement of the power means into movement of the dies. A workpiece receiving and retaining cavity is provided in association with a clamping and orientating device for locating a workpiece in a first floating position whereby the workpiece is floated in the clamping and orientating device by engagement of the dies until equal pressure is exerted on the workpiece by the dies and a generally equal precision coining can be accomplished.

In accordance with a more limited aspect of the present invention, a first movable platen is supported by the support means and disposed for longitudinal movement along the longitudinal axis. A second fixed platen supported by the support means is disposed generally opposite of the movable platen. The dies are fastened to associated die holder slides mounted for sliding radial movement on the movable platen. Driving blocks are fastened to the second fixed platen including an inclined face for cooperating camming engagement to a mating inclined surface of the die holder slides. The driving blocks include a selectively sizable shim for selective adjustment of coining depth. Positive return rods are disposed for cooperative camming engagement to the die holder slides whereby the dies are selectively moved away from the workpiece upon reverse longitudinal movement of the movable platen after coining of the workpiece.

One benefit obtained by the present invention is a coining assembly in which all dies are controlled by one main power source. Accordingly, all dies consistingly exert the same amount of pressure on the workpiece to allow the dies to coin the part consistently to the same depth at each die.

Another benefit obtained from the present invention is a coining assembly which allows floating of the part to be coined so that the part may shift until equal circumferential pressure is exerted thereon.

A further benefit of the present invention is an assembly providing shimmed dead stops for the coining press for ease of making set ups and adjustments of coining depth.

In accordance with a more limited benefit of the present invention, workpiece elevation is controlled in a receiving and retaining cavity by the use of an adjustable dead stop. Various length parts can be coined simply by adding a spacer to the locating dead stop. Accordingly, coining location can be moved up and down the part with extreme accuracies after only a simple adjustment.

Another benefit obtained from the present invention is a method which provides for orientation and clamping of the workpiece that allows for corrective adjustment and re-alignment. A double slider coupler in cooperation with an alignment plate allows the workpiece to maintain a generally preselected orientation while still floating in radial directions during the coining operation so equal penetration from all coin dies is effected.

Yet another benefit of the subject invention is the provision of a die head mount and die slides which are machined at matched angles to offer the mechanical advantage of a wedge and the precise uniform movement under equal pressures of a number of dies that is needed to coin with the desired precision and accuracy.

In accordance with a more limited aspect of the present invention, each die head can be adjusted for height to eliminate the need to have die heads machined in matched sets. Old resharpened dies and new dies can be mixed in a set up.

In accordance with yet another more limited aspect of the present invention, the depth of the coin area is controlled by an adjustable dead stop and shim assembly. Substantially unlimited coining depths and accuracies can be achieved.

Other benefits and advantages for the subject new method and assembly will become apparent to those skilled in the art upon a reading and understanding of this specification.

BRIEF DESCRIPTION OF THE DRAWINGS

The invention may take physical form in certain parts and arrangements of parts. The preferred embodiments of which will be described in detail in this specification and illustrated in the accompanying drawings which form a part hereof and wherein:

FIG. 1 is a front elevational view of a coining press assembly formed in accordance with the present invention;

FIG. 2 is an elevational view of a workpiece coined in the press of FIG. 1 comprising a rotor useful in a power steering rotary valve;

FIG. 3 is an enlarged cross sectional view taken along line 3—3 of FIG. 2, and particularly illustrating engagement of oil metering flat corners with a coining die as used with the press of FIG. 1, FIG. 4 is a graphic illustration of operational results of a power steering rotary valve including a rotor having coined corner breaks or chamfers at the oil metering flats and, alternatively, a rotor having no coined metering flat chamfer;

FIG. 5 is a cross sectional view taken along line 5—5 of FIG. 6 comprising an enlarged plan view of a movable platen employed in the assembly of the present invention particularly showing the die holder slides and slide guides;

Figure 6:
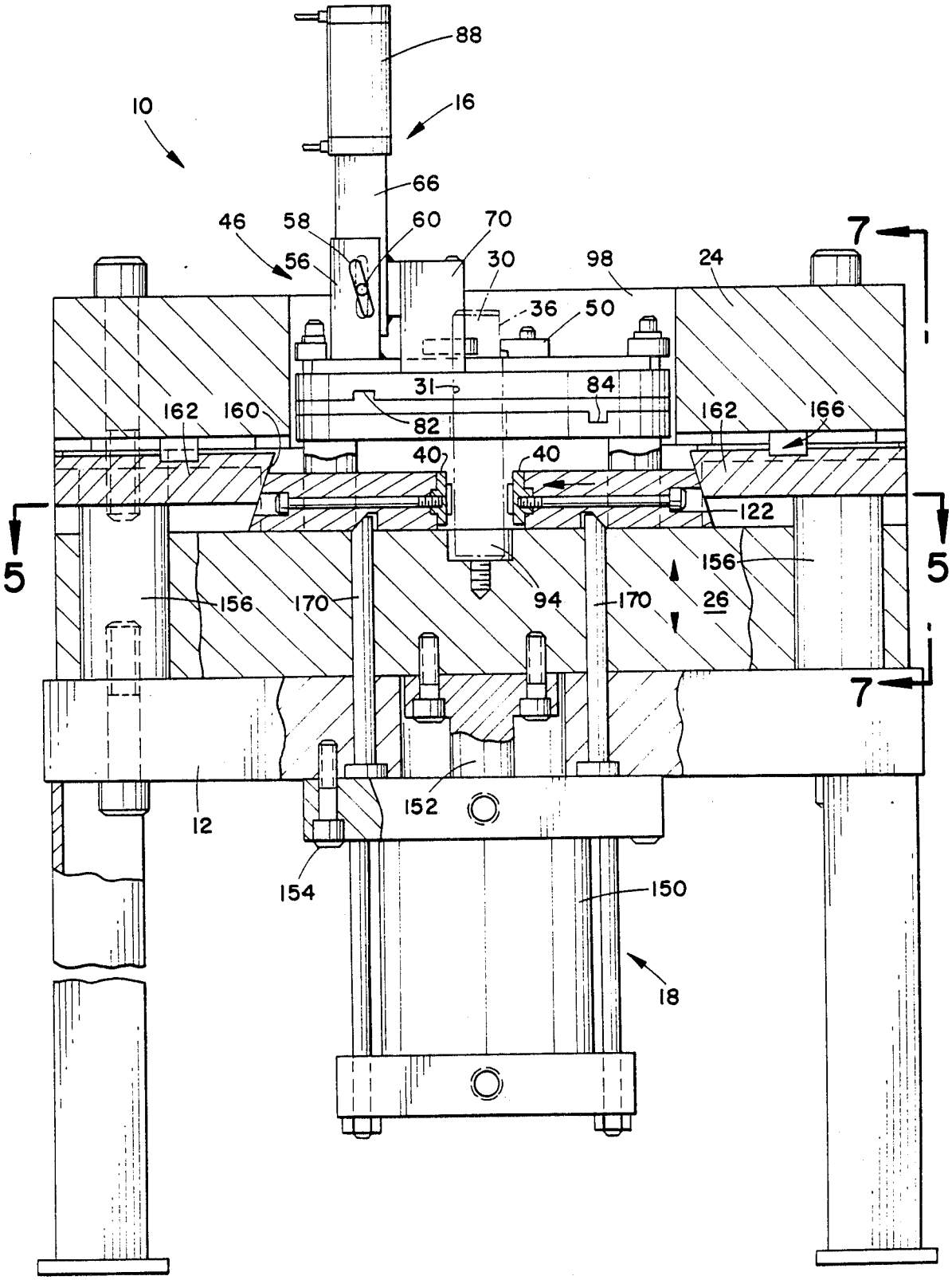
Figure 7:
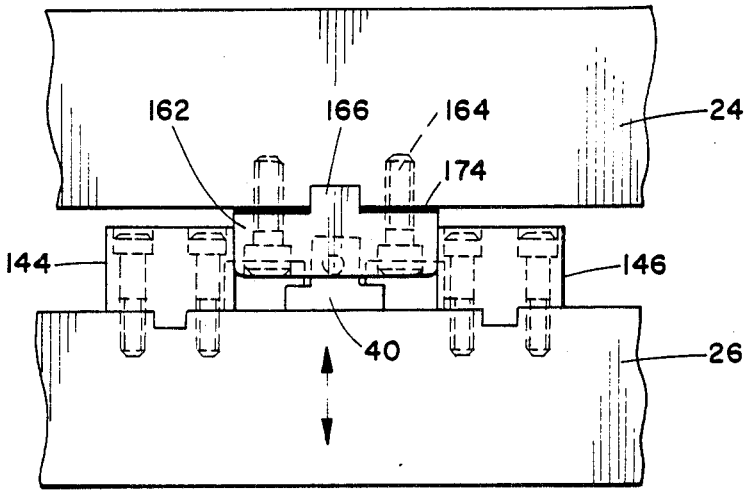
Figure 8:
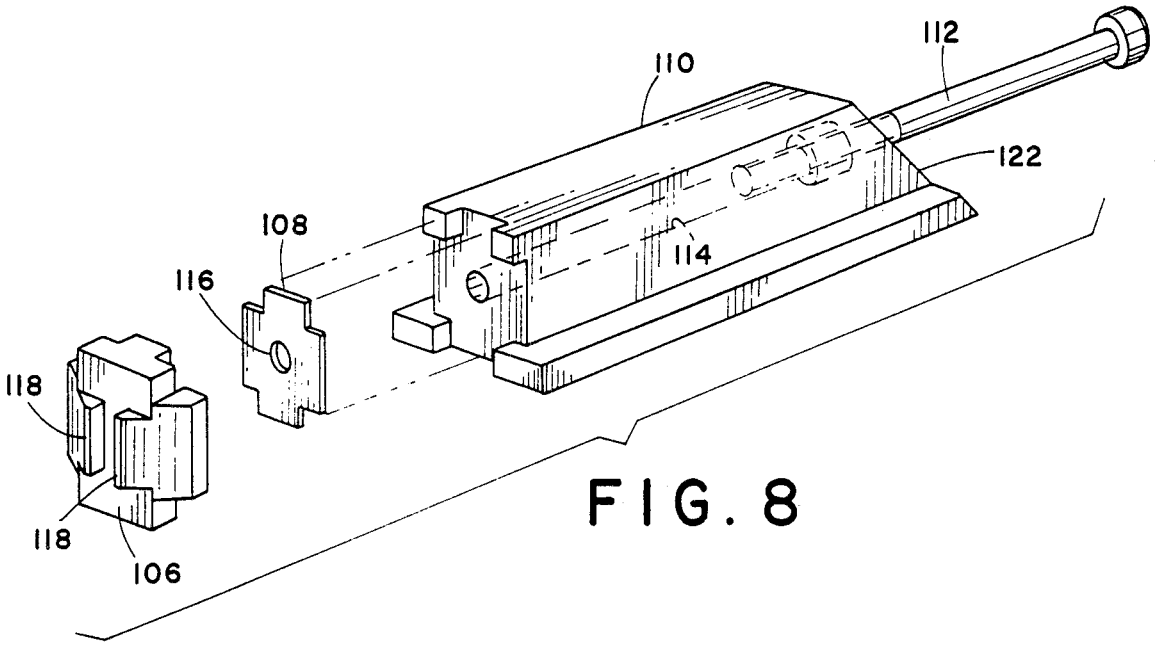
Figure 9:
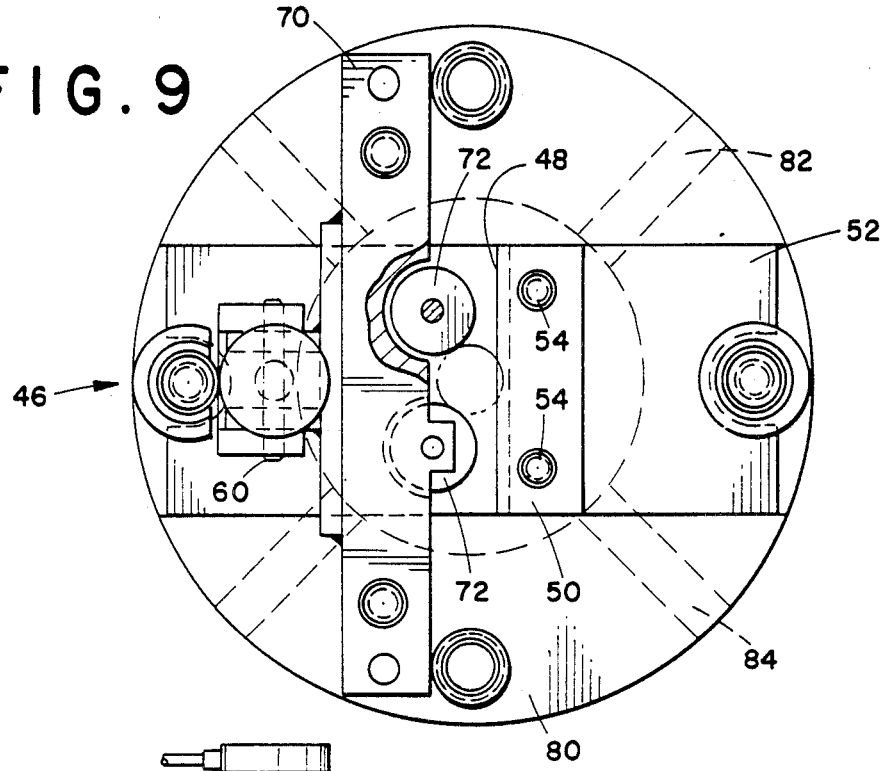
Figure 10:
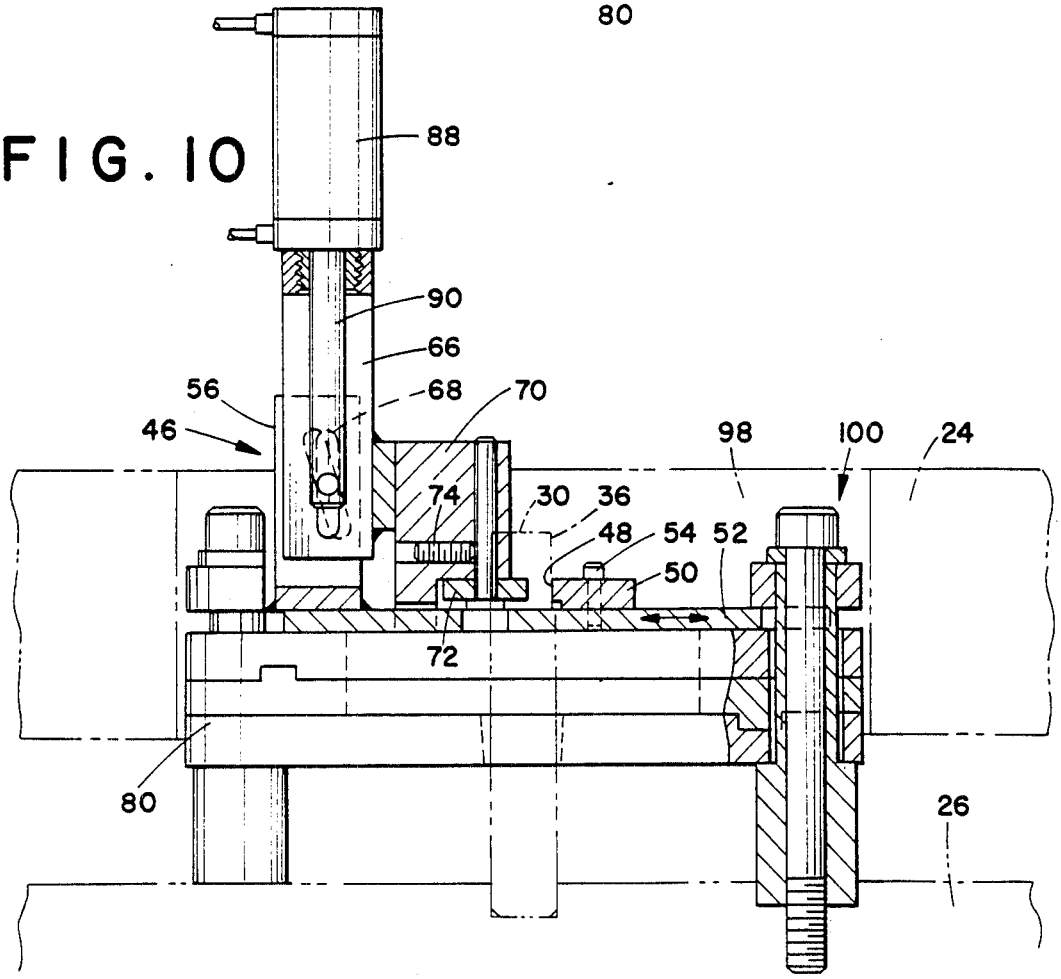

FIG. **5*a* is a partial cross sectional view taken along line 5*a*—5*a* of FIG. 5** also particularly illustrating a die holder slide and slide guides;

FIG. 6 is an enlarged, partial cross sectional view of a coining press formed in accordance with the present invention;

FIG. 7 is a side elevational view in partial section taken along line 7—7 of FIG. 5;

FIG. 8 is an exploded perspective view of a die holder slide, shim and die assembly;

FIG. 9 is a partial plan view in partial cross section particularly showing the clamping and orientating device of the press of the present invention; and, FIG. 10 is a side elevational view in partial cross section of the clamping and orientating device of FIG. 9 rotated 90° from the view of FIG. 9.

DETAILED DESCRIPTION OF THE INVENTION

Referring now to the drawings wherein the showings are for purposes of illustrating the preferred embodiments of the invention only and not for purposes of limiting same, the figures show a coining press assembly 10 (FIG. 1) particularly useful for selectively coining a corner break on oil metering flat of a rotary valve rotor for a power steering assembly. The assembly includes a support means for supporting components of the coining press comprising a support table 12 and legs 14. First and second piston and cylinder assemblages 16, 18 are mounted to the assembly for selective hydraulic functions as will be hereinafter more fully explained. First and second operator push buttons 20, 22 are provided for selective control of the piston and cylinder assemblages 16, 18. The press includes a fixed platen 24 at the top portion of the press and a movable platen 26 intermediate the first platen 24 and the support table 12. The power drive cylinder 18 drives the movable platen 26 along a longitudinal axis of the press 10 to effect coining of the workpiece in the press.

The part or workpiece 30 preferably coined in the press 10 is shown in FIG. 2. The part 30 includes oil metering flats 32 including precision corner breaks or chamfers 34 whose usefulness is conventionally known as a structural feature of such a part. In addition, the part 30 includes a locating and orientating flat 36 at the end portion of the part opposite the oil metering flats useful for alignment of the part 30 in the precision coining operation as will be hereinafter more fully discussed.

With reference to FIG. 3, it will be seen that the overall purpose of the coining press assembly 10 is to effect a coining of the corner break 34 with a die 40 by a radially directed punch engagement of the die 40 against the part 30. It is the method and structural features of the assembly for effecting this punch or coining result that is a particular feature of the subject invention.

More specifically, and with reference to FIG. 6, the workpiece 30 is placed in a receiving and retaining cavity 31 generally located at the longitudinal axis of the press 10 and orientated in a first floating position that is ultimately adjusted to a second coining position according to the following manner and method.

With additional reference to FIGS. 9 and 10, a clamping and orientation device 46 is employed to orient the workpiece 30 in the first floating position. An operator will generally align the workpiece 30 such that the locating and orientating flat 36 is disposed for mating engagement to an opposite flat 48 of locking or clamping bar 50. Accordingly, as the opposite flats engage, the workpiece 30 will be orientated in a particular radial alignment which is preselected so that the dies 40 are properly aligned for coining the corner breaks 34 adjacent the oil metering flats 32.

The clamping bar 50 is urged against the workpiece 30 by the first piston cylinder assembly 16 in the following manner. Clamping bar 50 is fastened to clamping slide plate 52 with conventional fasteners 54. As indicated in FIG. 10, slide plate 52 slides in a transverse direction relative to the workpiece 30 and is welded to a housing 56 including an angularly inclined pin slot 58 through which a pin 60 extends. The housing 56 partially encases a piston rod casing 66 including a longitudinally directed slot 68 through which pin 60 also extends. Piston rod casing 66 is secured as by a weld to a roller support bar 70 in which locating rollers 72 are fastened with a set screw 74 to provide a bias and orientating support to the workpiece 30 opposite of the clamping bar 50. It will be noted with reference to FIG. 9 that preferably a pair of rollers 72 are employed for such bias support but it is within the scope of the invention to include alternate nesting and orientating support means such as a V-block or other suitable structures.

The roller support bar 70 is additionally secured with conventional fastening devices to a double slider coupling or Oldham coupling 80 whose structure and operation is conventionally known. The coupler 80 includes key ways 82, 84 to allow radial floating of the workpiece 30 upon alignment in the first floating position set by the locating and clamping device 46.

The method of operation of the locating and clamping device 46 comprises energizing the cylinder 88 to induce a longitudinal movement of the piston rod 90 generally towards the coupler 80. Because pin 60 extends through the terminal end portion of the rod 90, and through piston rod casing 66 and housing 56, housing 56 will be urged into radial movement away from piston rod casing 66 in a direction generally away from the workpiece 30 by the movement of the piston rod towards the coupler. Accordingly, as housing 56 is so urged, clamping slide plate 52 likewise moves and, therefore, so does the locking or clamping bar 50 move towards the workpiece 30 so that bar flat 48 may engage workpiece flat 36. Upon such engagement, the workpiece 30 is urged to into engagement with rollers 72 until the workpiece is locked in a first floating position defined by somewhat circumferential engagement by the rollers 72 and the locking bar 50.

Upon completion of the coining operation, the workpiece can be removed from the press by energization of the cylinder 88 to induce the piston rod 90 to move generally away from the coupler 80 to urge the locking and clamping bar 50 away from the workpiece 30 and rollers 72.

In addition to the radial alignment of the workpiece, as noted above, the axial alignment and relative part elevation of the workpiece 30 is selectively adjustable with a threaded dead stop 94 (FIG. 6) disposed at the terminal end portion of the receiving cavity 31. In addition, cavity 31 is preferably funneled for operator ease in loading the workpiece 30 into the press 10.

With particular reference to FIGS. 6 and 10, it will be noted that the entire clamping and orientating device, including the coupler 80 is received in a cavity 98 in the fixed platen 24. As will be hereinafter more fully explained, the clamping device, coupler, and workpiece 30 are repeatedly moved through the cavity 98 in a cylical, longitudinal direction during the repetitive coining operations of the press as each workpiece is coined. As illustrated in FIG. 10, a conventional bolt and sleeve assembly 100 secures the orientation and clamping device to the movable platen 26.

With particular references to FIGS. 5–8, the coining step of the subject inventive method, as well as the structure for effecting the coin will be particularly discussed.

Each die 40 compresses a die head or tool 106, an adjustment shim 108, and a die holder slide 110 including an extended fastener 112 extending through the body of the slide 110, through a slide bore 114 and through a shim bore 116 for fastened reception in a tapped hole in the die tool 106 (FIGS. 6, 8). The configuration of the die head 106 preferably includes a pair of opposed work edges 118 sized to define the chamfer or corner break at the oil metering flat corners. The depth of coin is to be determined by the extent of pressure which urges the die into the workpiece. It should also be particularly noted that the die assembly 40 includes an inclined face 122 at the assembly back wall opposite of the die head 106. As inclined face 122 is to be employed as a camming surface, fastener 112 is recess mounted into the body of the die holder slide 110.

With specific reference to FIG. 5, it can be seen that the die assemblies 40 are circumferentially spaced about the workpiece 30. Although four die assemblies are shown, it is within the scope of the invention to include any number of such die assemblies. Each die assembly 40 is slidably mounted to the movable platen 26 with first and second die holder slide guides 126, 128. Each slide guide is fastened to the movable platen 26 with conventional fastening devices 130. Cooperating flanges 132, 134 of each slide guide 126, 128, respectively, are disposed opposite associated die holder slide side flanges 136, 138 (FIG. 5*a*). Accordingly, the die assemblies 40 are disposed for transverse sliding movement along the wall surface of the movable platen 26 in a controlled linear direction. The die holder slide 110 is closely received within the slide guides 126, 128 in order to obtain the advantageous precisely controlled positioning and operative movement of the die assembly 40.

With continued reference to FIG. 5, it will also be seen that a plurality of opposed sets of guide blocks 144, 166 are spaced about the movable platen 26 in general parallel alignment to the die assemblies 40. The guide blocks 144, 146 provide a dual function of serving as a guide for drive blocks 148 (FIG. 7) and also provide a precise dead stop for the extent of movement of the movable platen 26 towards the fixed platen 24 (FIG. 7).

As noted above, the clamping and retaining device 46 and the workpiece 30 aligned therein, radially float in coupler 80 depending upon radial forces applied to the workpiece, and in particular, the radial forces applied by the coining dies 40.

With reference to FIGS. 5 and 6, second power cylinder assembly 18 includes an hydraulic cylinder 150 and associated piston 152. The assembly 18 is mounted to the support table 12 with conventional fastener devices 154. The piston is also fastened conventionally to movable platen 26 to drive the platen longitudinally towards and away from fixed platen 24. Guide bars 156 fastened to the fixed platen 24 and support table 12 additionally closely control the movement of the movable platen 26.

The workpiece receiving and retaining cavity 31, and accordingly workpiece 30, are generally positioned along the longitudinal axis of the press and the movable platen 26 (FIG. 5). The circumferentially spaced die assemblies are urged into the workpiece 30 by a motion conversion means preferably comprising mating inclined camming surfaces comprising the inclined face 122 of the die assembly 40 and an inclined face or wall 160 of a drive block 162 disposed at a matched angle to inclined face 122. Drive block 162 is secured to fixed platen 24 with conventional fastening devices 164 and includes a tongue-in-groove assembly 166 additionally fixing the position of the drive block 162 relative to the fixed platen 24, and more particularly relative to die assemblies 40.

With reference to FIG. 6, as movable platen 26 is urged towards the fixed platen 24, the workpiece 30, the clamping and orientating device 46, the coupler assembly 80 and the die assemblies 40 are all moved longitudinally towards the fixed platen 24 and through fixed platen cavity 98. However, there is no relative longitudinal movement between the die assemblies 40 and the workpiece 30. Accordingly, the punch or coin of the die 40 is precisely determined by a preselected setting of the retaining cavity dead stop 94. However, since drive block 162 is fixed relative to the movable platen 26, movement of the die assemblies 40 towards the fixed platen will cause a camming engagement along camming surfaces 122, 160 which will urge the die assembly 40 into the workpiece 30 to effect the coining of the workpiece. Positive return rods 170 are fixed relative to the movable platen 26 such that each die assembly 40 is lifted away from the rods 170 as it is moved towards the fixed platen 24.

The motion conversion of the longitudinal movement of the piston 152 into the radial movement of the die assemblies 40 at the inclined faces 122, 160 offers the mechanical advantage of a wedge and the precise uniform movement of a plurality of die assemblies under equal pressures needed to coin with the accuracy required.

More particularly, each die assembly 40 will be effectively urged into engagement with the workpiece 30 by the longitudinal movement of the fixed platen 26. However, since the workpiece 30 is only set in a first floating postion by the retaining and clamping device 46 and the double slider coupling 80, the workpiece 30 is capable of radial adjustment movement resulting from the application of unequal radial forces by the die assemblies 40. Such radial adjustment will occur until the radial forces from the die assemblies 40 are equal about the workpiece 30 and the workpiece is fixed in a second coining position defined by the equal bias support to the workpiece from the dies. In other words, if the workpiece 30 were not precisely centered amongst the die assemblies 40, the first die assembly 40 to contact the workpiece 30 would radially move the workpiece until an equal and oposite force is applied against that first contacting die assembly through the workpiece. The equal and opposite force of course will be applied from the radially opposite die assembly. The effect of such a combination of cooperative and coordinated die engagements is that the workpiece 30 is always precisely centered in a preselected position before any coining occurs. The position of the workpiece is adjusted to the second coin position until an equal bias support is realized about the circumference of the workpiece and coining should properly occur. Since this entire step occurs in a dynamic operation, the method of the invention is economically efficient. Typical other prior art devices have fixed the workpiece on a fixed center line and adjusted the position of the workpiece die, roller, or milling tool. Obviously, any error in fixturing, power fluctuation, or contamination on the parts would create unequal coin depths and an undesirable work product.

In addition, it should be particularly noted that the subject invention includes only one power source for effecting the coining operation. That power source is the second power cylinder assembly 18. This avoids a typical problem of many prior art devices and methods which employ a number of power sources such as several power cylinder assemblies to apply the force necessary to effect the corner break. Where a number of different power sources are employed, the chances of each power source developing an unequal pressure to the others is greatly magnified and, accordingly, the liklihood of obtaining an undesirable workpiece is increased.

The precise coining depth to be made in the workpiece 30 is precisely controlled by adjustment of the positioning of the drive blocks 162. With particular reference to FIG. 7, a selectively sizable shim 174 is interset between the fixed platen 24 and the drive block 162 to adjust the effective depth of the drive block relative to the fixed platen 24. The greater the effective depth of the drive block 162, the further the die assembly 40 is urged into the workpiece 30. More specifically, the greater the shim depth 174 the greater the overlapping camming engagement between camming surfaces 122, 160 and, accordingly, the greater the radial movement of the die assembly. Since guide blocks 144, 146 set the extent of movement of the movable platen 26 towards the fixed platen 24, shims 174 can be set to adjust the height of the drive block 166 from a minimum depth set by the longitudinal dimension of the drive block without a shim, to a maximum extent generally equivalent to the longitudinal extent of the guide blocks 144, 146. The setting of die assembly dead stop positioning by the use of shims 174 provides a particularly advantageous assembly in ease of making set ups and in adjustment to the depth of coin.

In addition to adjusting coin depth by shimming drive block 162, it is also within the scope of the invention to adjust die coining depth by an adjustable die assembly shim 108 (FIG. 8). Adjustment of each die by relative adjustment of the positioning of the die head 106 relative to the slide 110 by selective sizing of shim 108, eliminates the need to have the die head machined in matched sets to provide equal coining depth. This is an advantageous benefit to the present invention in that it allows for a manufacturing method in which old resharpened dies and new dies can be mixed in a press set up.

The invention has been described with reference to the preferred embodiment. Obviously, modifications and alterations will occur to others upon the reading and understanding of the specification. It is our intention to include all such modifications and alterations insofar as they come within the scope of the appended claims or the equivalents thereof.

Having thus described our invention, we now claim:

1. A method of coining precision corner breaks on oil metering flats of an elongated rotary valve rotor having a longitudinal axis comprising the steps of:

placing a rotor to be coined in a first floating position disposed for coining adjustable orientation in a coining press, said rotor being placed on a platen movable longitudinally with said rotor axis;

substantially simultaneously engaging the rotor with a plurality of circumferentially spaced coining dies, said rotor floating from said first position to a second coining position defined by equal bias support of the dies to the rotor so that in floating from said first position to said second position said rotor moves in a plurality of different directions transverse to its longitudinal axis; and, coining the rotor with the dies by radial urging of the dies into the rotor with a motion conversion means for translating die coining pressure and travel from a common power means attached to said movable platen and said press whereby corner breaks are precisely coined on oil metering flats of the rotor.

2. The method as described in claim 1 wherein placing the rotor in the first floating position comprises insertion of the rotor in a clamping and orientating device including a selectively operable piston and cylinder assembly operatively engaged to a plurality of locating rollers and a rotor clamping bar, whereby said rotor is orientated in the first floating position upon clamping engagement between the rollers and the clamping bar.

3. The method as described in claim 2 wherein said rotor includes a locating flat disposed for generally mating engagement to an opposite flat of the clamping bar.

4. The method as described in claim 3 wherein said clamping and orientating device is mounted to a double slider coupling.

5. The method as described in claim 2 wherein said coining dies are received on said longitudinally movable platen, said motion conversion means comprising a first inclined face at a terminal end portion of a die holder slide and a second inclined face at a terminal end portion of a driving block disposed for camming engagement to the die holder slide, said engaging the rotor with a coining die comprising radial movement of the die holder slide to the rotor effected by longitudinal movement of the movable platen towards the driving block.

6. The method as described in claim 2 wherein the workpiece is mounted to a double slider coupling for floating support of the rotor from the first floating position to the second coining position.

7. An assembly for selectively coining a corner break in an oil metering flat of a rotary valve rotor comprising:

support means for supporting components of a coining press having a longitudinal axis;

a plurality of circumferentially spaced dies disposed for radial movement of said longitudinal axis, said dies being positioned upon a first longitudinally movable platen mounted on said support means;

a power drive piston and cylinder assembly for selectively moving said dies and attached to said support means and said first movable platen;

motion conversion means on said support means in operative communication between said piston and cylinder assembly and said dies for converting movement of said assembly into movement of said dies;

a workpiece recieving and retaining cavity on said movable platen;

a clamping and orientating device on said movable platen for locating a workpiece in a first floating position in said cavity whereby the workpiece is floated in said clamping and orientating device by engagement of the dies until equal pressure is exerted on the workpiece by the dies and generally equal precision coining is made thereon.

8. The assembly as claimed in claim 7 wherein the clamping and orientating device includes a double slider coupling for radially adjustable support of the workpiece.

9. The assembly as claimed in claim 7 including a second fixed platen supported by said support means, said dies being fastened to die holder slides mounted for sliding radial movement on said movable platen.

10. The assembly as claimed in claim 9 including driving blocks fastened to the second fixed platen, said motion conversion means comprising cooperating camming surfaces of said die holder slides and said driving blocks.

11. The assembly as claimed in claim 10 wherein said driving block includes a selectively sizable shim for selective adjustment of coining depth.

12. The assembly as claimed in claim 10 wherein said die holder slide includes a selectively sizable shim for selective adjustment of coining depth.

13. The assembly as claimed in claim 10 including positive return rods disposed for cooperative camming engagement to said die holder slides whereby said dies are selectively moved away from the workpiece upon reverse longitudinal movement of the movable platen after coining of the workpiece.

* * * * *